United States Patent [19]

Astier

[11] 4,114,410

[45] Sep. 19, 1978

[54] LOCKING DEVICE AND MEANS FOR ACTUATING THIS DEVICE

[76] Inventor: Pierre Jean Baptiste Astier, 76 Rue de Crimée, 75019 Paris, France

[21] Appl. No.: 836,546

[22] Filed: Sep. 26, 1977

[30] Foreign Application Priority Data

Oct. 20, 1976 [FR] France ..... 7631629

[51] Int. Cl.[2] ..... E05B 25/00

[52] U.S. Cl. ..... 70/339; 70/355; 70/383; 70/385

[58] Field of Search ..... 70/337, 339, 353, 354, 70/355, 365, 366, 382, 383, 384, 385

[56] References Cited

U.S. PATENT DOCUMENTS

| | | | |
|---|---|---|---|
| 2,970,466 | 2/1961 | Wellekens | 70/339 |
| 3,167,944 | 2/1965 | Pickering | 70/382 |
| 3,505,841 | 4/1970 | Sinclair | 70/350 |
| 3,555,858 | 1/1971 | Owen | 70/384 |
| 3,813,905 | 6/1974 | Sauder | 70/339 |
| 3,893,314 | 7/1975 | Raymond | 70/339 |

FOREIGN PATENT DOCUMENTS

| | | | |
|---|---|---|---|
| 692,736 | 6/1953 | United Kingdom | 70/385 |

*Primary Examiner*—Robert L. Wolfe
*Attorney, Agent, or Firm*—Curtis, Morris & Safford

[57] ABSTRACT

The invention relates to an improved device for opening a lock and a means for actuating the device. The device is characterized by a moving plunger or rotating wheel which is provided with slots which mesh with at least two rocking tumblers which engage the slots when they are biased by a reference card and thus prevent movement of the plunger or wheel. The rocking components can be disengaged from the slots when they in turn are biased by the proper keycard, thereby freeing the plunger or wheel and allowing operation of the mechanism of the lock.

12 Claims, 12 Drawing Figures

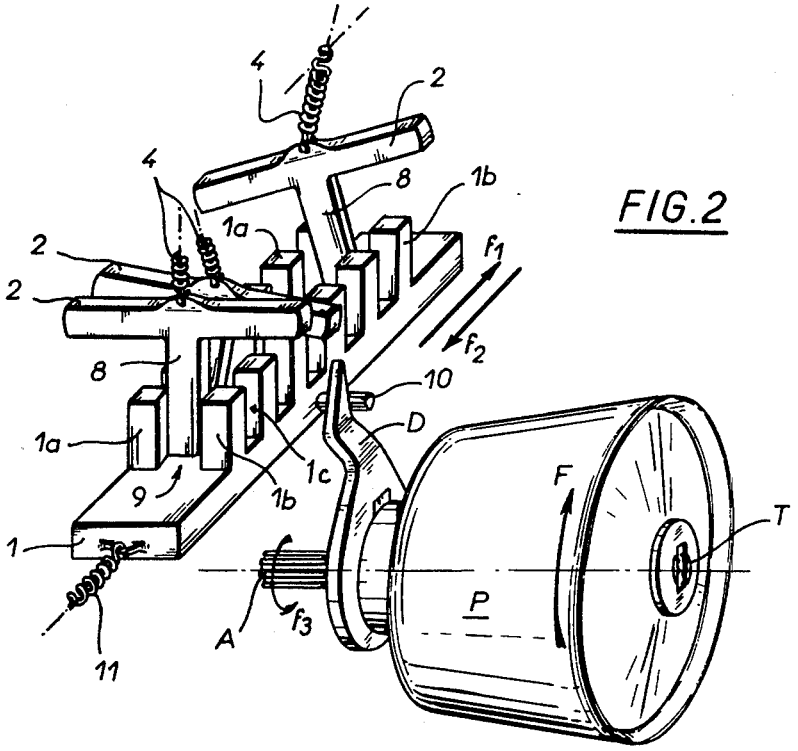
FIG.2
FIG.7
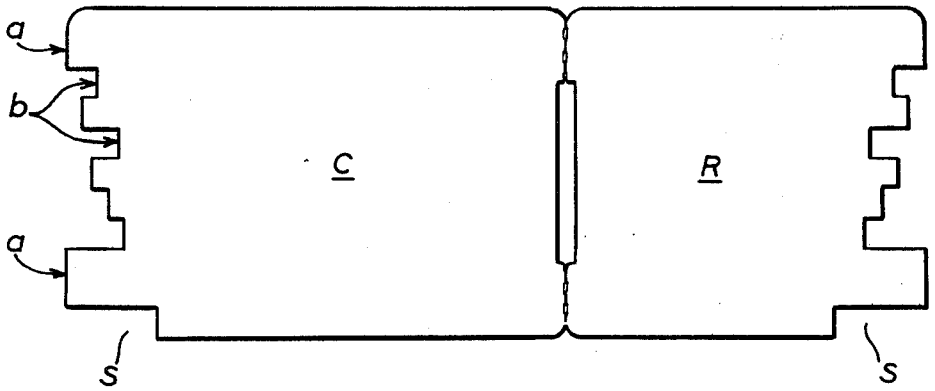

LOCKING DEVICE AND MEANS FOR ACTUATING THIS DEVICE

The invention relates to an improved device for opening a lock. It also relates to the means for acting on this device.

It is well known that the locks now most currently used reqire special keys adapted to each lock for their operation. The loss of the key intended for a given lock results in either having to remake the key, if possible, or having to replace the lock. Undeniably, this presents disadvantages and can be troublesome if it occurs several times.

In the hotel industry, there is also the problem of identifying the room or aparement keys assigned to each guest. The guest, depending on the bulk and/or weight of the key tag (balls, metal plaques or the like) attached to his key, very often finds the key cumbersome to carry. Furthermore, in some instances, the guest is not authorized to keep the key during his stay. Therefore, he is obliged to entrust it to the person responsible for the premises, thereby creating a great inconvenience. Another problem exists in that the keys are frequently and easily lost or misplaced. There are in existence today devices using electrical or electronic means energized by magnetic or punched cards in association with a remote control station. These systems are expensive and involve the use of electrical connections within the door. Other entirely mechanical systems such as described in U.S. Pat. Nos. 3,893,314 and 3,555,858 involve the use of complex mechanisms or offer a limited number of combinations and cannot be used just as an addition to existing locks.

Therefore, the present invention discloses a device which avoids these inconveniences, namely a device which can be adapted to all existing locks and a card, hereafter referred to as a keycard, which replaces a conventional key. The keycard is intrchangeable at will but in spite of this interchangeable nature, it allows the operation of the lock only by the keycard holder to the exclusion of all others except for holders of a master key which directly actuates the standard lock to which the mechanism herein described is added. To effect this, the device according to the invention includes a removable component (designated the reference component) which is the exact counterpart of the keycard. This component acts on the device and permits correct operation of the mechanism of the lock only if the keycard which is introduced actually corresponds to the component. This component and the keycard can be a planer member in the form of a plate, a card, or the like, for example, like the various credit cards now currently in use.

Thus, for a given period of time, the reference component remains in place in the device according to the invention and only the holder of the corresponding keycard car enter. However, in case of loss or other incident, the key normally assigned to the mechanism of the lock or a "master" key in the particular case of a hotel room, would permit entry. It then suffices to replace the reference component and to provide another keycard corresponding to this component to correct the situation.

It is easy to understand the great interest which such a device would generate in the hotel industry, because it provides a plurality of different reference components, and allows the hotel to assign to each guest a corresponding keycard which the guest can retain during his stay. This keycard, because of its form, is easy to carry and helps ensure the lock's inviolability (apart from the "master key" standard in all hotels) in that the lock cannot be opened with another keycard. This is therefore a convenient means of providing a single key fitted to each assigned room, serving only under particular circumstances, and capable of being changed in other particular circumstances.

Preferably, the device according to the invention is characterized by the fact that it is comprised of moving plunger, or a rotating wheel provided with slots which mesh with at least two rocking tumblers which engage the slots when they are biased by the reference component and thus prevent movement of this plunger or wheel. These rocking components are disengaged from the slots when they in turn are biased by the proper keycard thereby freeing the plunger or wheel and allowing operation of the mechanism of the lock.

In accordance with a simple embodiment, the plunger acts on the existing bolting or locking device of a lock mechanism so that it allows actuation of the bolt.

In another embodiment, the plunger is engaged directly with the bolt actuating device of the lock and operation of the latter is possible only if the plunger itself is not impeded in its movement.

According to a characteristic of the invention, the reference component and the keycard are preferably made in one piece which can be divided in two practically identical components.

This invention is also characterized by the use of a series of identical interference rockers individually supported by a spring to permit free rotation and translation of each rocker.

According to a feature of the invention, a direct path for the withdrawal of the locking bolt is cleared by the selective operation of identical interference components.

According to another feature of the invention, keycards and reference cards are made available in book form.

Other characteristics and advantages of the invention will be apparent from the description of the accompanying drawings in which:

FIG. 1 is a plan view of an example of a card which can be separated in two to provide a reference component and a keycard consistent with the invention;

FIGS. 1*a*, 1*b*, and 1*c* are explanatory diagrams of the invention;

FIG. 2 is a perspective view of one form of construction possible of a device according to the invention;

Figure 6A:
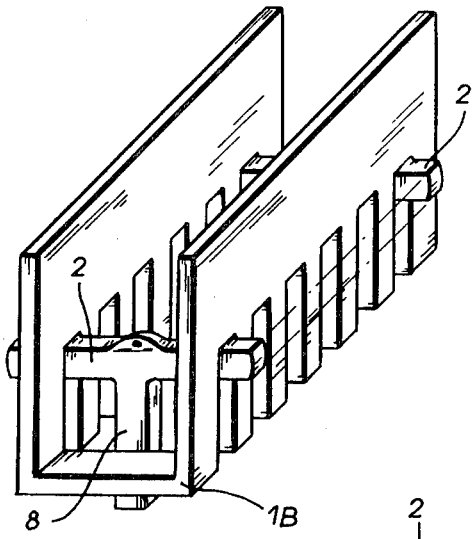
FIG. 6 is an end view of a door fitted with its lock and on which is adapted the device according to the invention.
Figure 6:
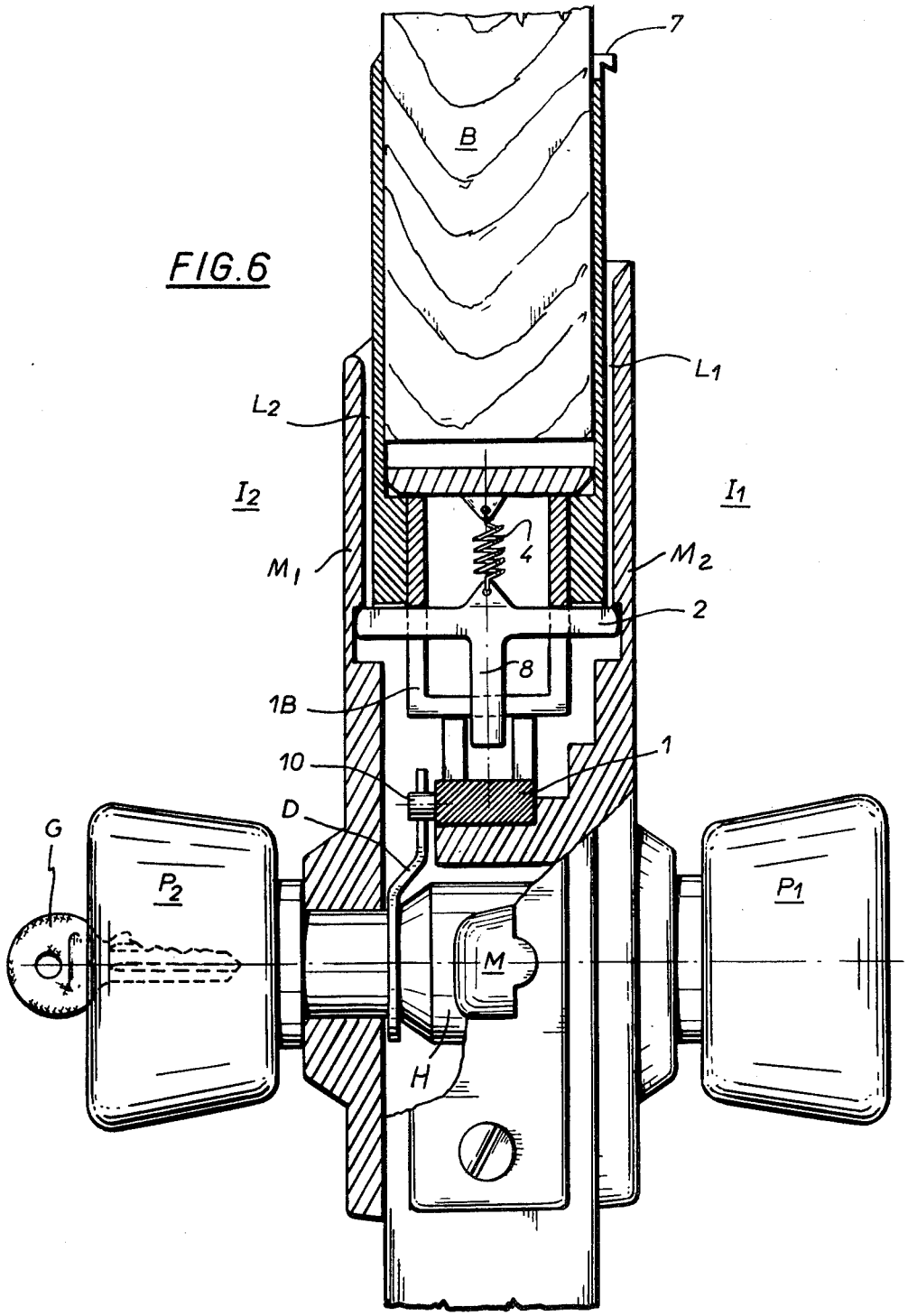
Figure 8:
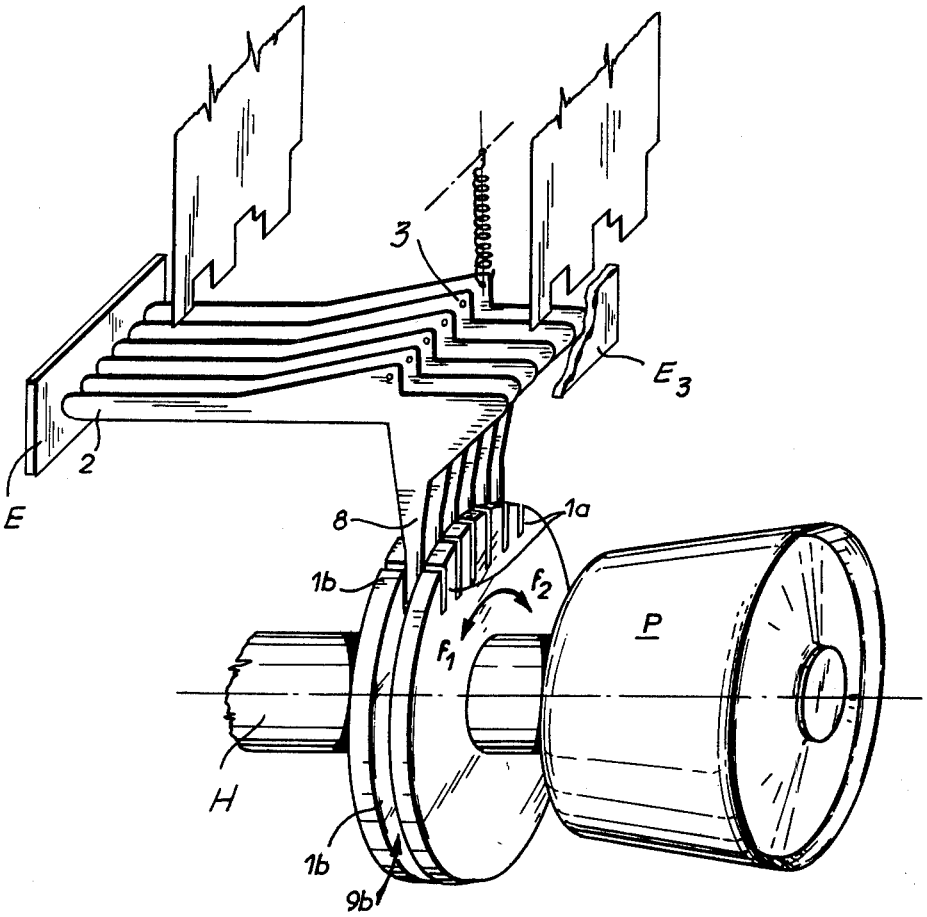

FIG. 6*a* is a perspective view of a detail of FIG. 6;

FIG. 7 is a plan view of a reference and keycard suitable to the device according to the invention; and FIG. 8 represents a preferred embodiment of the invention.

Figure 1C:
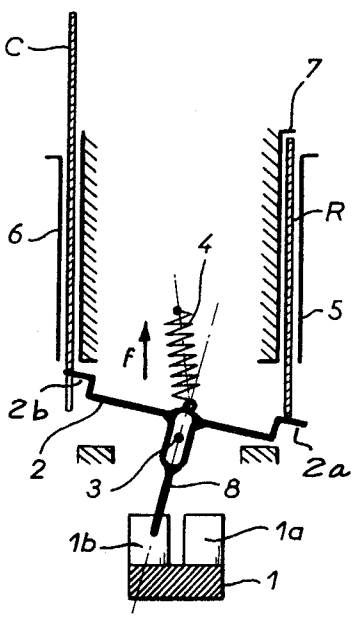
Figure 1B:
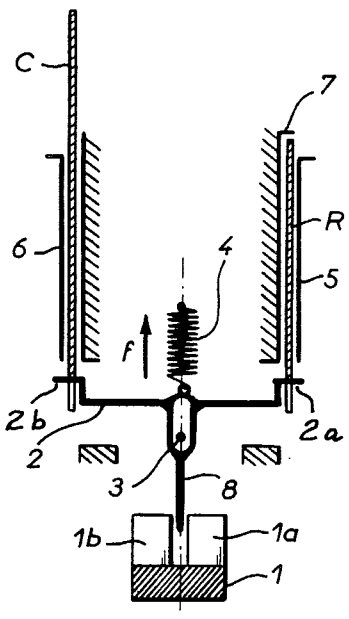
Figure 1A:
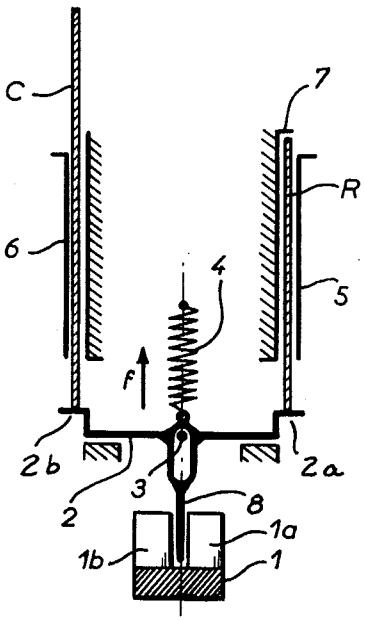
Figure 1:
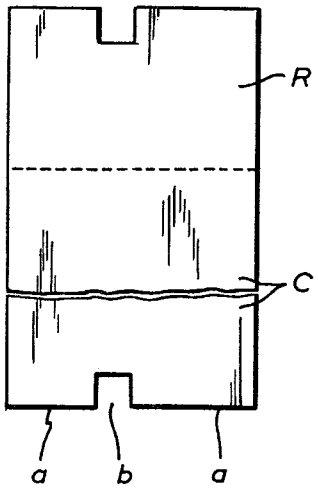

Referring to FIG. 1, a keycard - reference card unit according to the invention is shown. Represented schematically in FIGS. 1*a* to 1*c* is the method of operation of a lock using these two kinds of cards.

Referring to FIGS. 1, 1*a*, 1*b* and 1*c*, the device according to the invention comprises part 1, a plunger or wheel having teeth with slots between the teeth, which serves to actuate the bolt of the lock, as will be explained below. This part works together with a cross-shaped part 2 hinged at 3 and biased by a return-spring 4 (in the direction of arrow f). The length of the horizontal leaves of part 2 is such that their ends are positioned perpendicular to two rims provided in the lower section of the two openings 5 and 6 which accept and guide the reference card R, shown at 5 and the keycard C, shown at 6. The two cards are identical, that is, their lower section is provided with the same pattern of notches of different depth.

In order to facilitate the understanding of the mechanism, one notch only is shown in FIG. 1. However, it must be understood that one of the characteristics of the invention resides in the use of a plurality of notches of various depths. When reference card R is introduced into its opening 5, and permanently held in this opening by a suitable retaining system such as a catch 7, the card R, either by one of its peaks (a) or the bottom of the notch (b) bears against the end 2*a* of a leaf of part 2. The latter is then in the position represented in FIG. 1*c*. The vertical leaf 8 of this part is tilted and takes a position in front of a tooth 1*b* of part 1 and prevents all movement of the latter in a plane perpendicular to the drawing and, thereby, prevents any direct action on the bolt of the lock. To free part 1, it is necessary to bring the vertical leaf 8 of the cross-shaped piece 2 to the position represented in FIG. 1*a* or 1*b*. To accomplish this, keycard C is inserted into its opening 6. Because its pattern of notches is identical to that of card R, its lower section, homologous to that of this card R will, either by the bottom of its notch (b) or by one of its peaks (a), bear against the corresponding end 2*b* of the leaf of part 2 to rock the latter by an amount equal to and in a direction opposite to that which caused its initial rocking. Part 2 thus frees the plunger or wheel 1, since the vertical leaf 8 no longer prevents the movement of this part in a plane perpendicular to the plane of the drawing. The illustration in FIG. 1a corresonds to the biasing of the cross-shaped piece by a peak (a), and the illustration in FIG. 1b corresponds to the biasing of the cross-shaped piece by the bottom of a notch (b).

FIG. 2 represents a simple method of implementation of the invention. Following this method, the plunger or wheel 1, intended to act on the actuating lever of the bolt or latch (not illustrated) of a lock is provided with a series of teeth 1*a*, 1*b*, having between the teeth slots 1*c* and a longitudinal channel 9, meshing with a series of cross-shaped pieces 2 whose number is a function of the degree of security to be accorded to the lock. In the example illustrated in FIG. 2, part 1 is intended to mesh with six cross-shaped pieces 2 of which only three are shown for the sake of clarity in the drawing. In this method of implementation, when the vertical leaves 8 of the parts 2 are all situated in the longitudinal channel 9, actuating plunger 1 can be displaced in the direction of arrows $f_1$–$f_2$. This part can be actuated by the intermediary of the standard doorknob P, in a familiar kind of lock, (in the direction of arrow F) through pawl D mounted on the shaft of this doorknob and bearing on a catch 10 integral with part 1, the latter being drawn back by a spring 11. On the other hand, when the displacement of the plunger 1 is prevented by one of the parts 2 (as illustrated), the rotation of the doorknob is no longer possible, since only the combination of the keycard and the reference card allow actuation of the plunger or wheel of the lock. In the case where, for some reason, it is not possible to produce this combination, the latch can nonetheless be actuated by a master key of the classical sort which is introduced into doorknob P (through slot T, for example, of a "tumbler" kind of lock) and which acts in a familiar manner on pawl D in the direction of arrow $f_3$, which then permits the free rotation of doorknob P in the direction of arrow F and driving shaft A into direct contact with the bolt, in spite of the blocking of plunger 1.

Figure 3:
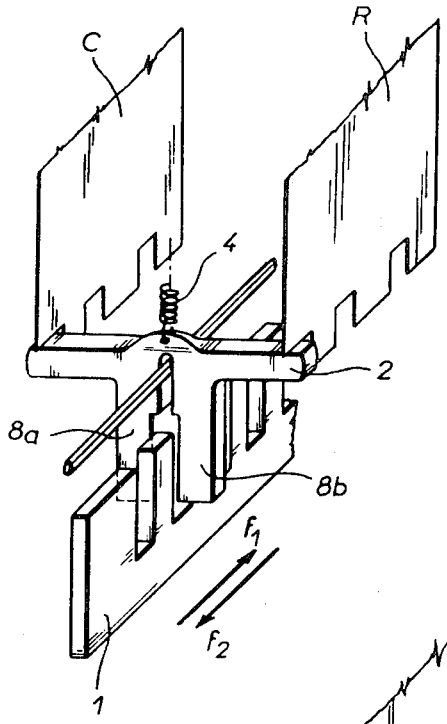
FIG. 3 is a perspective view of a variant of implementation.

FIG. 3 shows another embodiment of plunger 1 and cross-shaped pieces 2. According to this variant, plunger 1 is a slotted plate and part 2 is provided with two vertical leaves 8*a* and 8*b* which straddle part 1. As in the device shown in FIG. 2, when the two vertical leaves of 8*a* and 8*b* are rocked, the displacement of part 1 in the direction of arrows $f_1$–$f_2$ cannot occur.

Figure 4:
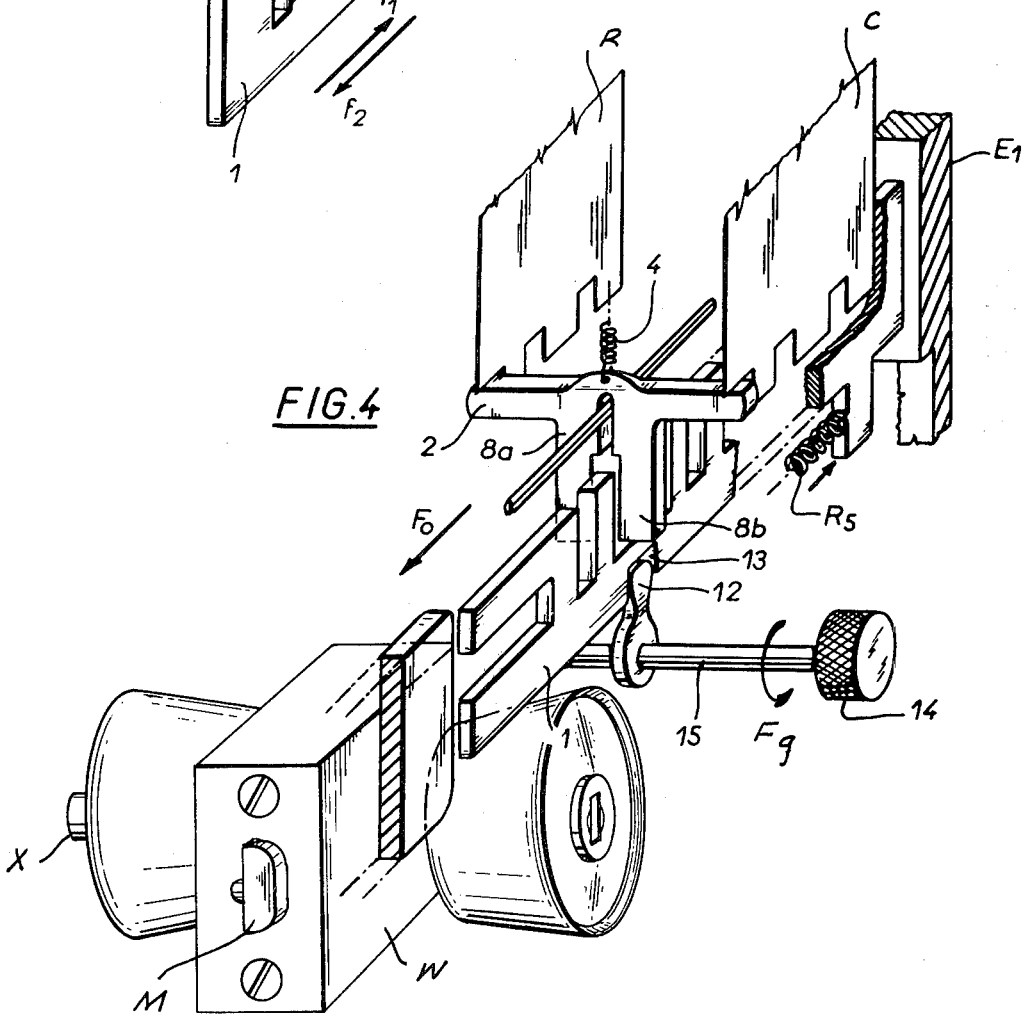
FIG. 4 is a perspective view of a device according to the invention applied to the working of an existing lock.

Another embodiment of the present invention is shown in FIG. 4 which is adapted for use with a conventional keyless type button type lock W. With this type of lock, when one button X is pressed the locking device of the lock is actuated and the bolt M is locked to prevent actuation of the outside doorknob and to prevent entry into the room. The arrangement of this embodiment of the invention permits the button locking device to be operated from outside the room to permit entry into the room. Normally the plunger 1 is held in its retracted position against element $E_1$ by spring $R_5$ and movement thereof in the direction $F_o$ is blocked by the vertical leaf 8*a* due to the presence of card R in the lock inside the room. In this position plunger 1 has no effect on lock W. To release the bolt, plunger 1 is freed for translatory movement in the direction $F_o$ by inserting card C in the lock to release leaf 8*a* from plunger 1, as explained above. The plunger 1 can then be moved in the direction of arrow $F_o$ by turning knurled knob 14 in the direction of arrow $F_9$. The knurled knob 14 is located adjacent the outside surface of the door and is secured to a shaft 15 rotatably mounted in the door. Shaft 15 has a pawl 12 mounted thereon which fits into a recess 13 in the plunger 1. The plunger 1 is operatively connected in any suitable manner to the locking device of the lock W and movement of the plunger 1 in the direction $F_o$ causes the locking device to disengage, i.e. it causes the previously depressed locking button X to be released. Thus, bolt M can then be actuated by turning the outside doorknob.

It stands to reason that this unlocking can be effected, following from the kind of lock contemplated, by translatory movements, rotative movements, or by the combination of a translation and a rotation.

Once the plunger 1 has fulfilled its function, it is drawn back to its initial position, butting against the component $E_1$ through the action of spring $R_5$.

Figure 5:
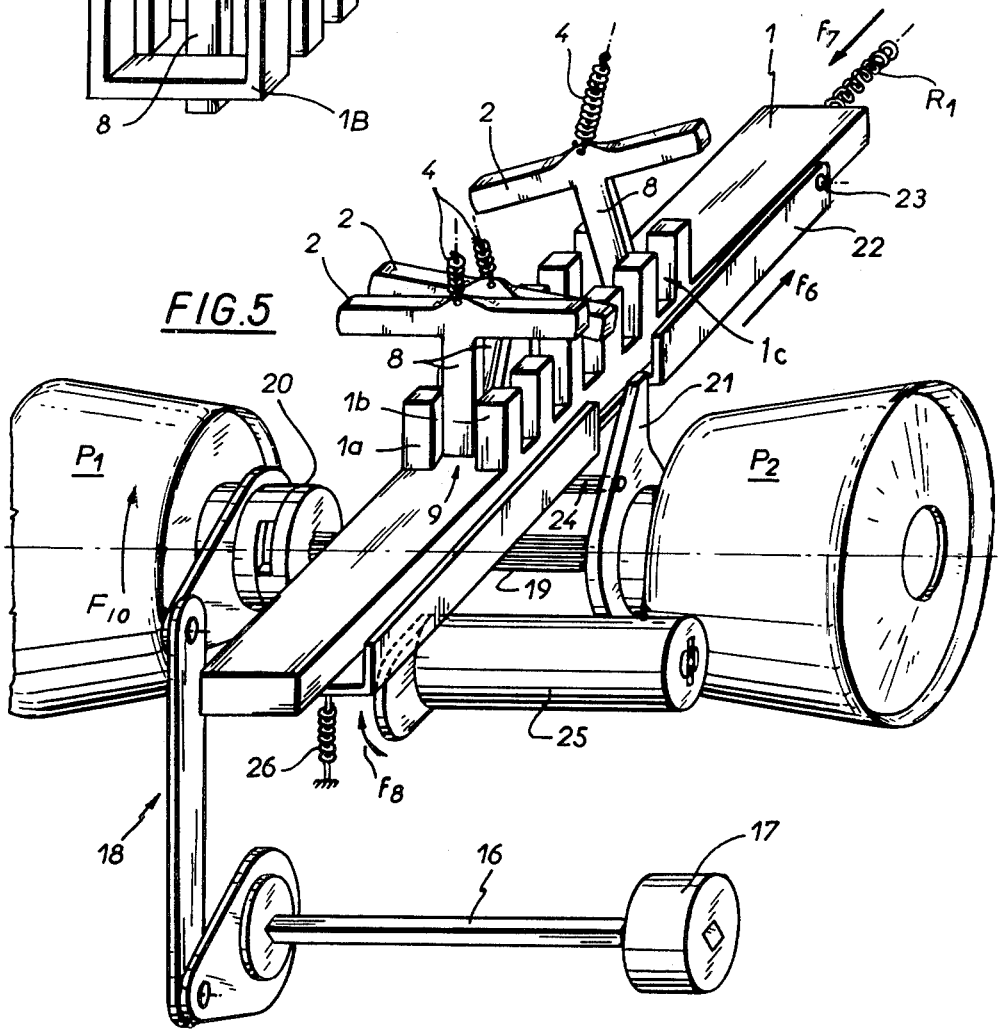
FIG. 5 is a view analogous to FIG. 4, in a variant application.

FIG. 5 illustrates another embodiment of the invention easily applicable to all kinds of existing locks.

Represented in this figure is the usual square shaft 16 traversing an equally usual lock (not illustrated). The doorknobs associated with this square shaft have been removed and replaced on one side by a retaining end piece 17, and on the other by a bell crank linkage 18 (or any equivalent system, such as a rack and pinion) to rotate shaft 16 by action on the actuating doorknobs $P_1$ and $P_2$ of the device according to the invention.

Doorknob $P_1$ (located inside the room) is permanently free to actuate, through linkage 18, and the square shaft 16 consequently actuates the bolt. On the other hand, its rotation does not necessarily cause the rotation of the shaft 19 and thus of doorknob $P_2$. Knob $P_1$ can rotate in the direction of arrow $F_{10}$ to lift link 18 and unlock the door independently of doorknob $P_2$ through the action of clutch 20. The clutch makes it possible to open the door from the inside even though plunger 1 is not in the released position. Knob $P_1$ is maintained in the rest (unoperated) position through the action of a spring (not shown) part of the usual mechanism of the lock controlled by shaft 16 and associated parts. Integral with doorknob $P_2$ and shaft 19 is a pawl or lever 21 provided with an extension designed to engage a slot, as shown, of "L" shaped lever 22 pivoted at 23 on plunger 1.

If, as previously explained, plunger 1 is prevented from moving by the cross-shaped pieces 2, then the doorknob $P_2$ cannot be actuated and cannot actuate the square shaft 16. On the other hand, in the case where free sliding movement is made possible for part 1, doorknob $P_2$ can be actuated by the fact that pawl 21 can move easily with part 1 in the direction of $f_6$. This results in direct actuation, through 18, of square shaft 16 (and thus on the lock). The displacement of part 1 (and of pawl 21) is limited by a stop 24 when the return spring $R_1$ brings back, in the direction of $f_7$, the combination to its initial position.

In the case where it is necessary to operate the lock mechanism in the absence of the keycard according to the invention, a secondary device is provided, comprising a lock 25 whose rotation in the direction of arrow $F_8$ results in the lifting of lever 22 against spring 26, thus freeing pawl 21 from its catch, and thereby allowing actuation of doorknob $P_2$.

FIG. 8 shows a preferred embodiment of the invention which can easily be installed on any standard existing door. In this embodiment, the tumblers 2 pivot at 3 and/or move vertically between guide pieces $E_2$ and $E_3$. Guide pieces $E_2$ and $E_3$ prevent the tumblers from moving laterally and can be in a form such as the mounting plates $M_1$ and $M_2$ shown in FIG. 6. The tumblers 2 are provided with a vertical extension 8, as shown. These extensions serve the same purpose as the similar extensions or leaves shown in the previous embodiments.

In all the embodiments described, the use of notches of different depths makes it possible to obtain a large number of different combinations without relying on a large number of notches, thus keeping the size of cards down to, for example, the size of standard credit cards. For example, six notches and ten different depths enable the selection of 999,999 different combinations obtainable with substantially wide and therefore rigid tongues (material left between notches).

The various embodiments described above are applicable to any standard lock and can easily be installed on a door as illustrated in FIG. 6. This figure represents a transverse sectional view of the edge of a door B on which is installed the device according to the invention following one of the manners of implementation. On the inside $I_1$ of the room, the door is provided with a guide opening $L_1$ into which is inserted the reference card R (of which an example is illustrated in FIG. 7). The card is provided, for example, with a series of notches of various depths and a cut-out S which avoids insertion of the card upside down. As previously explained, when this card is in place in its guide opening, each of the cross-shaped pieces 2, meshing with one of the slots, rock a corresponding amount. FIG. 6a represents two cross-shaped pieces 2 in their cradle 1B. The doorknob $P_2$ (outside the room) does not allow actuation of the lock, and consequently does not allow access to the room when the door is closed.

On the other hand, the inside doorknob $P_1$ is connected to the conventional door bolt actuator mechanism H of the lock and allows actuation of the bolt M when it is turned. The reference card R, although interchangeable, is held in its opening $L_1$ so that it bears constantly against the cross-shaped pieces. The card is kept in place by the retaining part 7.

Consistent with the invention, the insertion of a keycard for which the contour and dimensions of its pattern of notches are identical to those of reference card R, into an opening $L_2$, allows the return of the cross-shaped pieces 2 to the position allowing free movement of plunger 1 (as illustrated in FIG. 6). The reference card and keycard are not shown in this figure for the sake of clarity.

In the position illustrated in FIG. 6, the doorknob $P_2$ can be turned and the bolt M actuated to open the door. The door can be opened, as explained above, without the use of a keycard, by means of a standard key G.

It is to be understood that it is not necessary to provide a door with a standard key lock together with the locking device of the present invention. The locking device of the present invention will provide adequate security when used by itself. Such an embodiment is shown in FIG. 8. As a further example, the standard key lock can be eliminated from the embodiment shown in FIG. 6, and the locking device of the present invention by itself can be used to allow or prevent actuation of the bolt actuator mechanism H.

It follows that correct operation of the lock is uniquely a function of the matching pattern of notches on the reference card and on the keycard. It also allows that it is impossible to actuate the lock if the notches do not match. This represents a factor of security, and in case this security is in doubt, it suffices to change the reference card to provide another unlocking possibility by means of another keycard identical to the new reference card.

This principle can be applied in many fields, but notably in that of the hotel industry. Indeed, as indicated above, it is well-known in this industry that the loss of a key can result in the necessity of having to change the locks. Furthermore guests and staff are compelled to handle a quantity of keys whose number is a function of the number of rooms. The identification of each key is accompanied by more or less heavy and/or cumbersome tags attached to the keys. It is also difficult to avoid either deterioration or loss of these standard hotel room keys. Now, in accordance with the invention, the keys can be made in the form of planar members, cards or plaques of lightweight and inexpensive materials such as cardboard, plastic, thin metal sheets or the like. These cards, for each given contour, can be made in two copies, one corresponding to the reference card and the other to the keycard. For each guest, the reference card is inserted in the guide opening on the inside of his room or apartment door and is changed for each guest or in case of loss. These cards are obviously disposable and can be kept by the guest for the duration of his stay since they are not cumbersome but are in a form much like all the well known credit cards. They can even be sent by mail thus allowing the guest upon his arrival to immediately enter the room reserved for him, the hotel keeper having already inserted the reference card into the door of the room.

An advantage of the invention resides also in the fact that the contour of the keys necessary to actuate a lock can be changed economically and at will without having to change the mechanism in the lock. It also reduces worry of burglary, since in case of doubt, the reference card and the corresponding keycard can be changed.

Furthermore, it is to be understood that the above description of the present invention is illustrative and is in no way limiting. Various modifications can be made by those skilled in the art without exceeding the scope of the invention.

What is claimed is:

1. An improved device which can be adapted to an existing lock to allow the actuation thereof, the device being characterized by the fact that it consists of a movable plunger provided with slots which mesh with at least two rocking components meant to engage in the said slots when they are biased by insertion into this device of a notched reference component to prevent movement of said plunger, said rocking components being adapted to be disengaged from said slots and freeing said plunger by the insertion into this device of a second notched component identical to said reference component, to permit direct actuation of the mechanism of the lock.

2. A device as claimed in 1, in which said plunger is operatively engaged with the bolting mechanism of the lock, so as to allow actuation of the bolt.

3. A device according to claim 1, in which the reference component and the second component are planer members and are provided with a series of notches of varying depths, these components and their series of notches being identical and in groups of two.

4. A locking device in a door for use in cooperation with the locking mechanism of the door, said locking mechanism including a door handle, and said device comprising:

moving means moveably mounted within said door and operatively associated with the door handle of said locking mechanism for movement therewith upon actuation of the handle in a direction to open the door;

a plurality of rocking components pivotally mounted within said door and pivotally settable to an operative position in which the component blocks movement of the moving means and an inoperative non-blocking position;

a reference means for biasing said rocking components to said operative position;

a key means for biasing said rocking components to said inoperative position against the bias of said reference means;

said rocking components and said moving means having cooperating means for engaging each other when at least one of said rocking components is biased by said reference means to its operative position so that movement of the moving means and actuation of the door handle of the locking mechanism is prevented and the movement of said moving means and actuation of said door handle is permitted when said rocking component is biased by said key means to said inoperative position.

5. A locking device adapted for use in a door for use in cooperation with the locking mechanism of the door, said locking mechanism including a door handle and said device comprising:

means adapted to be moveably mounted within said door and operatively connected to the door handle of said locking mechanism for movement therewith upon actuation of the door handle in a direction to open the door;

a plurality of rocking components adapted to be pivotally mounted within said door and pivotally settable to an operative position to block movement of the moving means and an inoperative non-blocking position;

reference means adapted to bias said rocking components to said operative position;

key means adapted to bias said rocking components to said inoperative position against the bias of said reference means;

said rocking components and said moving means having cooperating means adapted to engage each other when at least one of said rocking components is biased by said reference means to its operative position so that movement of the moving means and actuation of the door handle of the locking mechanism is prevented and the movement of said moving means is permitted when said rocking components are biased by said key means to said inoperative position.

6. A locking device kit having component parts capable of being assembled for use in cooperation with the locking mechanism of a door said locking mechanism including a door handle, and said kit comprising the combination of:

means adapted to be moveably mounted within said door and operatively connected to the door handle of said locking mechanism for movement therewith upon actuation of the door handle in a direction to open the door;

a plurality of rocking components adapted to be pivotally mounted within said door and pivotally settable to an operative position to block movement of the moving means and an inoperative non-blocking position;

reference means adapted to bias said rocking components to said operative position;

key means adapted to bias said rocking components to said inoperative position against the bias of said reference means;

said rocking components and said moving means having cooperating means adapted to engage each other when at least one of said rocking components is biased by said reference means to its operative position so that movement of the moving means and actuation of the door handle of the locking mechanism is prevented and the movement of said moving means is permitted when said rocking components are biased by said key means to said inoperative position.

7. The device as claimed in claim 4, wherein:

said moving means comprises a plunger slidably mounted within the door;

said cooperating means on said moving means including a row of teeth on the plunger, with a slot defined between adjacent teeth;

said rocking components comprise a plurality of T-shaped tumblers; and said cooperating means on said tumblers each comprising a leaf which meshes with a slot between adjacent teeth on the plunger when said tumblers are biased to their operative position so that the slideable movement of said plunger and actuation of said door handle is prevented and said leaves disengaging their associated slots when their tumblers are biased to their inoperative position so that the movement of said plunger and actuation of said door handle is permitted.

8. The device as claimed in claim 4, wherein:

said moving means comprises a wheel rotatably mounted within said door and having a row of teeth and slots between adjacent teeth defining said cooperating means on said moving means; and said rocking components comprise a plurality of T-shaped tumblers each including a leaf defining said cooperating means on the rocking components; and said leaves meshing with the slots between said teeth when said tumblers are biased to their operative position so as to prevent rotational movement of said wheel and actuation of said door handle and said leaves disengaging said slot when the tumblers are biased to their inoperative position so as to permit rotational movement of said wheel and actuation of said door handle.

9. The device as claimed in claim 7, wherein:

said plunger has a first and second row of teeth, said first and second rows being substantially parallel and having a longitudinal channel between them, each row having substantially the same number of teeth and having a slot between adjacent teeth and each tooth and slot of said first row being substantially aligned on each side of said longitudinal channel with a corresponding tooth and slot of said second row; and said tumblers each have one leaf and said leaf meshes with the slot between said teeth of said first row when said tumblers are biased to their operative position so that the slidable movement of said plunger is prevented and actuation of said door handle is prevented, said leaf disengaging said slot and being positioned in said longitudinal channel between said first and second rows of teeth when the tumblers are biased to their inoperative position so that slidable movement of said plunger and actuation of said door handle is permitted.

10. The device as claimed in claim 8, wherein:

said wheel has, along at least a part of its circumference, a first and second row of teeth said first and second rows being substantially parallel and having a longitudinal channel between them, each row having substantially the same number of teeth and having a slot between adjacent teeth and each tooth and slot of said first row being substantially aligned on each side of said longitudinal channel with a corresponding tooth and slot of said second row; and said tumblers each have one leaf and said leaf meshes with the slot between said teeth of said first row when said tumblers are biased to their operative position so that rotational movement of said wheel is prevented and actuation of said door handle is prevented, said leaf disengaging said slot and being positioned in said longitudinal channel between said first and second rows of teeth when the tumblers are biased to their inoperative position so that rotational movement of said wheel and actuation of said door handle is permitted.

11. A locking device in a door for use in cooperation with the locking mechanism of a door, said locking mechanism including a door handle, a lockable bolt, a means for unlocking said bolt, said device comprising:

moving means moveably mounted within said door;

means for actuation of said moving means operatively connected to said moving means;

said moving means operatively associated with the means for unlocking for movement therewith upon actuation of said means for actuation in a direction to unlock the bolt;

a plurality of rocking components pivotally mounted within said door and pivotally settable to an operative position in which the component blocks movement of the moving means and an inoperative non-blocking position;

a reference means for biasing said rocking components to said operative position;

a key means for biasing said rocking components to said inoperative position against the bias of said reference means;

said rocking components and said moving means having cooperating means for engaging each other when at least one of said rocking components is biased by said reference means to its operative position so that movement of the moving means and actuation of means for unlocking the bolt of the locking mechanism is prevented and the movement of said moving means and actuation of said means for unlocking the bolt is permitted when said rocking component is biased by said key means to said inoperative position.

12. The device as claimed in claim 4, wherein said reference means and key means comprise planar members each having an identical series of notches of varying depths.

* * * * *